US005535725A

United States Patent [19]

Baker et al.

[11] Patent Number: 5,535,725

[45] Date of Patent: Jul. 16, 1996

[54] FLOW CONTROL SOLENOID MEANS

[75] Inventors: Scott J. Baker, Mansfield; Richard E. Garrison, Bellville; Eric L. Matson, Lexington, all of Ohio

[73] Assignee: Hi-Stat Manufacturing Co., Inc., Sarasota, Fla.

[21] Appl. No.: 308,677

[22] Filed: Sep. 19, 1994

[51] Int. Cl.[6] ..... F02M 37/04

[52] U.S. Cl. ..... 123/520; 137/630.15; 251/129.15

[58] Field of Search ..... 123/520, 519, 123/518, 521, 516, 198 D; 137/630, 630.15; 251/129.15

[56] References Cited

U.S. PATENT DOCUMENTS

| | | | |
|---|---|---|---|
| 2,952,331 | 9/1960 | Beach | 183/34 |
| 2,976,950 | 3/1961 | Smith | 183/4.3 |
| 3,076,630 | 2/1963 | Hammond | 137/630.15 |
| 3,191,588 | 6/1965 | Thew | 123/136 |
| 3,447,568 | 6/1969 | Burkart | 137/630.15 |
| 3,563,274 | 2/1971 | Tischler | 137/630.15 |
| 3,721,069 | 3/1973 | Walker | 55/319 |
| 4,024,848 | 5/1977 | Lee | 123/136 |
| 4,093,437 | 6/1978 | Ichihara | 55/487 |
| 4,141,703 | 2/1979 | Mulchi | 55/316 |
| 4,929,261 | 5/1990 | Jacobson | 55/213 |
| 5,058,693 | 10/1991 | Murdock et al. | 180/69.4 |
| 5,103,794 | 4/1992 | Shiraishi | 123/520 |
| 5,228,597 | 7/1993 | Low | 137/630.15 |
| 5,237,980 | 8/1993 | Gillier | 123/520 |
| 5,284,121 | 2/1994 | Abe | 123/520 |
| 5,289,811 | 3/1994 | Couert | 123/520 |
| 5,341,787 | 8/1994 | Zabeck | 123/520 |
| 5,347,971 | 9/1994 | Kobayashi | 123/520 |
| 5,398,724 | 3/1995 | Vars | 251/129.16 |

*Primary Examiner*—Carl S. Miller
*Attorney, Agent, or Firm*—Lon H. Romanski

[57] ABSTRACT

A solenoid operated valving assembly is shown functionally between a fuel vapor canister of a vehicle and the engine of such vehicle; the valving assembly has at least two valving members a first of which is caused to at least start to open upon the attainment of first indicia of engine operation to thereby flow vapors from the canister to the engine and a second of which is caused to at least start to open upon the attainment of second indicia of engine operation to thereby flow vapors therethrough from the canister to the engine.

24 Claims, 8 Drawing Sheets

ECU
DC
64a
14a
16a
18a
66a
68a
74a
72a
12a
54a
56a
58a
48a
40a
42a
26a
22a
30a
28a
84a
110a
60a
62a
44a
46a
82a
50a
24a
38a
32a
34a
36a
10a
52a
80a
76a
78a
100a
158a
172a
312a
94a
170a
162a
318a
126a
169a
160a
182a
168a
156a
96a
98a
176a
174a
306a
622
270a
166a
110a
164a
112a
175a
624
70a
620
224a
226a
272a
322a
228a
122a
612
214a
232a
90a
92a
608
614
222a
220a
610
218a
116a
86a
88a
128a
210a
120a
114a
118a
106a
108a
102a
104a

FLOW CONTROL SOLENOID MEANS

FIELD OF THE INVENTION

This invention relates generally to solenoid means and more particularly to solenoid means for controlling fluid flow. The solenoid means is effective to control the rate of fluid flow in response to signals produced by related and associated operating mechanism.

BACKGROUND OF THE INVENTION

Because of environmental concerns the automobile industry now produces the automotive vehicles so as to have respective ones of such vehicles comprise a fuel vapor recovery system which usually includes a charcoal canister operatively connected to the vehicular fuel tank for collecting fuel vapors from the fuel tank, for example, as the fuel tank is being refilled. After the fuel tank is filled and the vehicular engine is started, the charcoal canister is placed under purge whereby fuel vapors in the canister are purged as to the vehicular engine.

The invention as herein disclosed is primarily directed to the flow control of fluid, such as, for example, fuel vapors and the more accurate rate of flow of such fluid as well as to other related and attendant problems in the prior art.

SUMMARY OF THE INVENTION

According to the invention, a solenoid operated valving assembly comprises electrical coil means for at times creating a magnetic flux field, pole piece means effective for conducting said flux field when created by said electrical coil means, wherein said valving assembly comprises housing means, wherein said housing means comprises first and second passages formed therein, armature means generally axially spaced from said pole piece means, said armature means being effective to at times cause the prevention of fluid flow into and through said second passage and the flow of said fluid past said armature means and through said first passage.

Various general and specific objects, advantages and aspects of the invention will become apparent when reference is made to the following detailed description considered in conjunction with the accompanying drawings.

BRIEF DESCRIPTION OF THE DRAWINGS

In the drawings, wherein for purposes of clarity, certain elements may be eliminated from one or more views.

DETAILED DESCRIPTION OF THE PREFERRED EMBODIMENT

Figure 1:
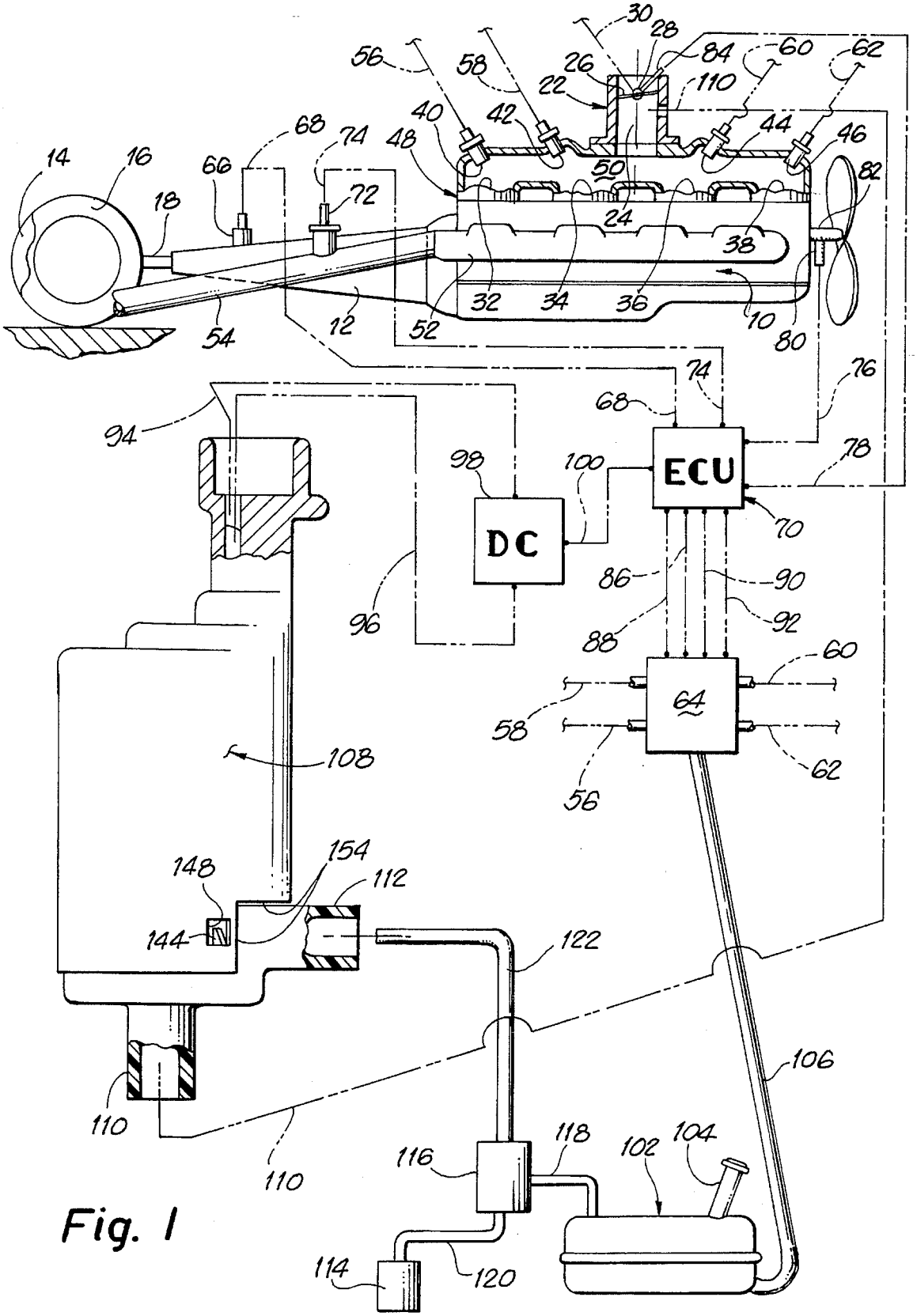
FIG. 1 is a diagrammatic and schematic view depicting a vehicle provided with an engine, ground engaging wheels, and power transmission means along with a vehicular fuel tank, a canister for receiving fuel vapors, atmospheric air inlet means, solenoid valving means and interconnections depicting an overall operating system employing teachings of the invention.

Referring now in greater detail to the drawings, FIG. 1 depicts various portions of, for example, an automotive vehicle showing such comprising a vehicular prime mover or engine 10 having an output power transmission 12 leading from the engine 10 to ground engaging drive wheels 14 and 16 as through a drive or propeller shaft 18 and related drive means from the drive shaft 18 to the wheels 14 and 16.

The engine 10 is shown as comprising an intake manifold 20 which, through a throttle body 22 communicates with ambient atmosphere as via induction passage means 24 the flow through which is controlled as by a throttle valve 26 carried as by a rotatable throttle shaft 28. Suitable manually controlled linkage or motion transmitting means 30 is effective for rotating the throttle shaft 28 and throttle valve 26.

The engine 10 is also depicted as comprising four piston-cylinder areas 32, 34, 36 and 38 (provided with intake and exhaust valves not shown but well known in the art) which are respectively provided with metered fuel via fuel injector means or assemblies 40, 42, 44 and 46. During engine operation, the throttle valve means 26 is selectively opened permitting ambient air to flow in induction passage 24, past throttle valve 26, and into the intake manifold 48 passage means 50 leading to the individual engine combustion chambers.

The exhaust gases are discharged from the piston-cylinders and into a suitable exhaust manifold as generally depicted at 52 which, in turn, leads to the vehicular exhaust pipe 54.

Respective portions of conduits 56, 58, 60 and 62 shown operatively connected to fuel injectors 40, 42, 44 and 46, are actually respectively connected to the continuing conduits or conduit portions as to be in fluid conveying relationship with a suitable fuel supplying fuel divider assembly 64.

As best seen in the generally upper half of FIG. 1, a vehicular speed sensor and signal generating means 66 is shown operatively carried by and operatively connected to the vehicular transmission means 12. The electrical speed signal created by speed sensor 66 is conveyed as along suitable conductor means 68 to associated electronic control unit means 70. The magnitude and character of the speed signal is related to the vehicular speed.

As also generally depicted, the engine exhaust gases flow from the exhaust manifold through the exhaust conduit means 54 and to the ambient atmosphere. An exhaust gas sensor 72 is shown operatively connected to conduit 54 as to sense the exhaust gas flowing therethrough and be responsive to the constituents of the exhaust gas as, for example, being responsive to the amount or percentage of oxygen in the exhaust gas. The sensor 72 is effective for creating and producing an output electrical signal reflective of the sensed exhaust gas; such electrical signal is applied as along conductor means 74 to the ECU 70.

Additional electrical signals are transmitted as via conductor means 76 and 78 to the ECU 70. Suitable engine speed sensing means 80, operatively connected as to an engine speed related output shaft 82, is operatively connected to the conductor means 76, so as to produce an output signal related to engine speed. A throttle position sensor 84 senses the then existing position of throttle means 84 and in response thereto creates an electrical signal, reflective of the engine load and the position of throttle 84, which is applied to the ECU 70 via said conductor means 78.

The ECU 70 receives such operating parameter signals, via 68, 74, 76 and 78, along with possibly additional signal inputs of other selected monitored indicia of engine and/or vehicular operation.

As is generally well known in the art, the ECU 70 comprises an electronic processor which, upon receiving all the desired operating inputs, processes such and produces related or resulting outputs. For example, conductor means 86 may provide a control signal from the ECU 70 to the fuel delivering means 64 and, in particular to possibly the means associated with regulating the rate of fuel flow through conduit means 56. Similarly, conductor means 88, 90 and 92 may provide respective control signals from the ECU 70 to the fuel delivery means 64 and in particular to possibly the means associated with regulating the rate of fuel flow through conduit means 58, 62 and 60.

Conductor means 94 and 96 are shown operatively connected to opposite sides of a direct current power source 98 which, in turn, is operatively connected to the ECU 70 via conductor means 100.

A vehicular fuel tank 102 such as, for example, a tank for being filled with gasoline, as through a filler tube or conduit 104, has a fuel supply or delivery conduit means 106 communicating with and leading from tank 102 and progressing into operative connection with the fuel flow divider means 64.

A valving assembly 108 is provided with an upper portion (as viewed in FIG. 1) which operatively receives electrical conductor means 94 and 96. In the generally lower portion of FIG. 1 conduits 110 and 112 are depicted with conduit 110 leading as through an aperture in the wall of throttle body 22 and communicating with the induction passage, as 24, at an elevation below that of the nominally closed throttle valve 26.

A fuel vapor canister is depicted at 116 and is shown as having, in effect, two inlet conduits 118 and 120. Conduit 120, preferably, may lead from suitable ambient air inlet filter means 114. The conduit 122, exiting canister 116 is shown in communication with conduit 112.

Figure 3:
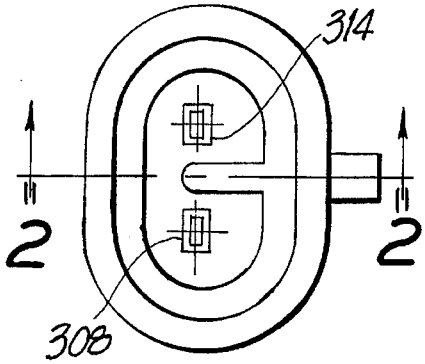
FIG. 3 is an end view taken generally on the plane of line 3—3 of FIG. 2 and looking in the direction of the arrows.
Figure 2:
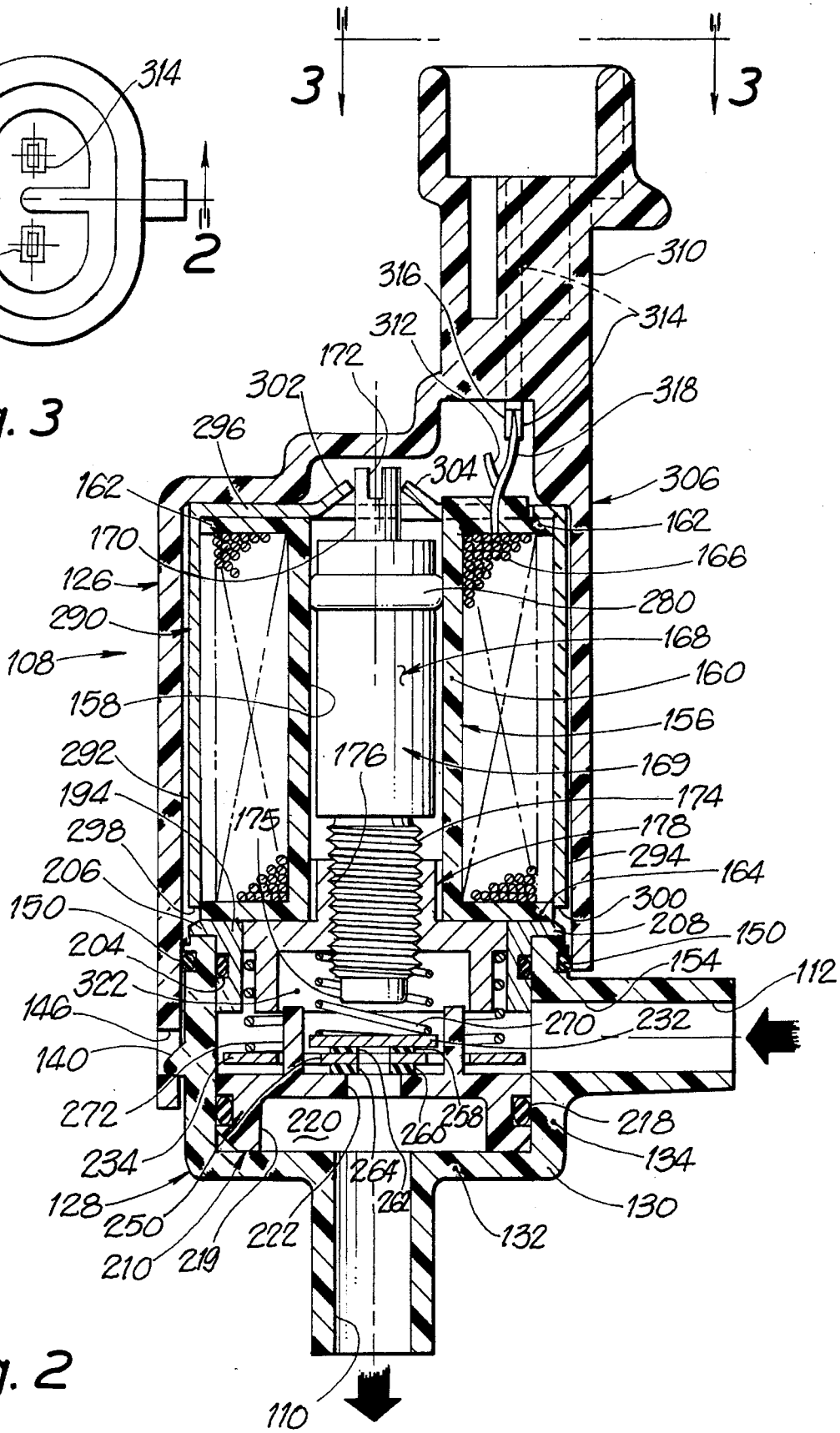
FIG. 2 is a generally enlarged view of the solenoid valving means of FIG. 1, shown in longitudinal axial cross-section as if taken on the plane of line 2—2 of FIG. 3.

FIGS. 2 and 3, in relatively enlarged scale, better illustrate the solenoid valving mechanism 108 shown in FIG. 1.

Generally, referring primarily to FIGS. 2 and 3, the assembly 108 is shown as preferably comprising an outer housing assembly 124 which, in turn, is generally comprised of what may be considered an upper situated outer housing portion 126 and a cooperating lower disposed housing portion 128. Preferably, the housing portions 126 and 128 are each formed of material which does not conduct magnetic flux; in the preferred embodiment housing portions 126 and 128 are each formed of nylon. "Nylon" is a generic name for a family of polyamide polymers characterized by the presence of the amide group—CONH.

Figure 5:
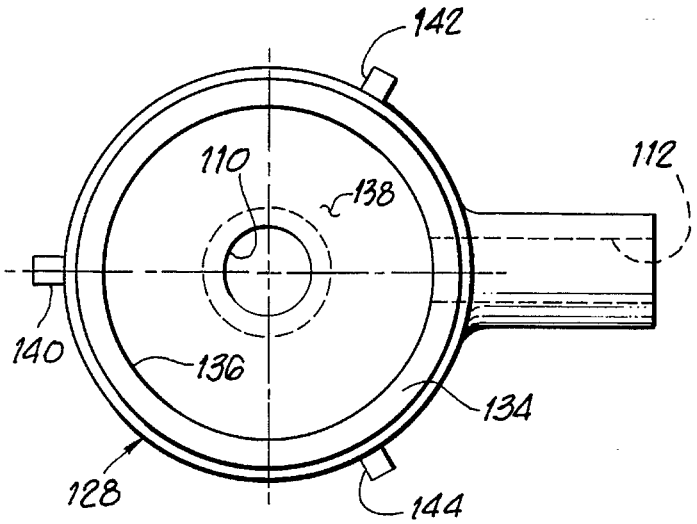
FIG. 5 is a view taken generally on the plane of line 5—5 and looking in the direction of the arrows.
Figure 4:
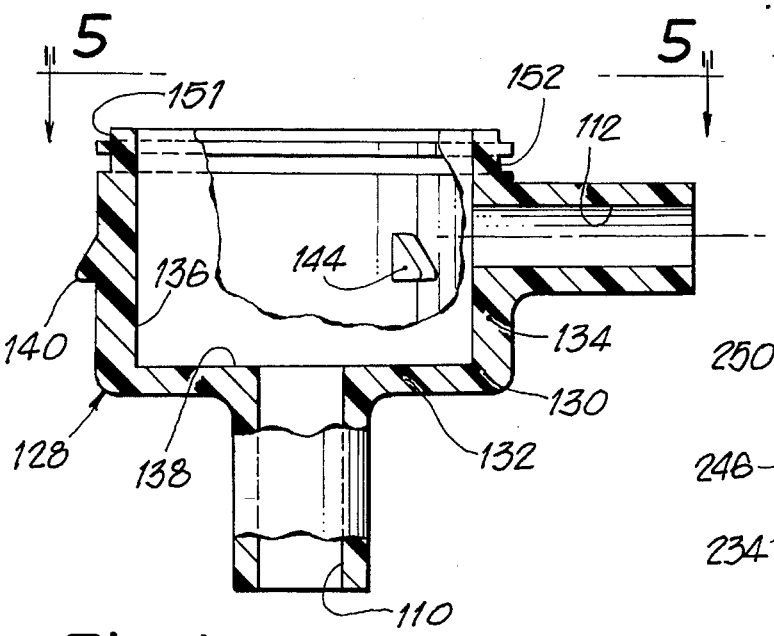
FIG. 4 is a view, partly in cross-section and partly in elevation of one of the elements shown in both FIGS. 1 and 2.

As generally depicted in FIG. 2, the housing section 128 is shown as comprising a cup-like shaped main body 130 which has an axial end wall 132 with integrally formed conduit 110 extending axially away from axial end wall 132. A generally cylindrical wall 134 is formed integrally with the end wall 132 and, as in the assembled condition depicted, axially extends toward and at least partly into housing section 126. Further, FIGS. 2, 4 and 5 show conduit 112 formed integrally with cylindrical wall 134 and communicating with cavity 136 formed in housing section 128. The generally cylindrical cavity 136 preferably terminates as in an axial end surface 138 of end wall 132.

As depicted in FIGS. 2, 4 and 5, the housing section 128 is preferably provided with three extending ramp-type retaining tabs 140, 142 and 144 effective for operatively engaging, for connection purposes, to and with housing section 126.

The upper housing section 126 is provided with three cooperating openings, two of which are depicted at 146 and 148, for respectively operatively and lockingly receiving the locking tabs or ramps 140, 142 and 144 therein.

FIGS. 1 and 2 illustrate the upper housing 126 as being effectively closed at its shown upper end and the lower end being operatively connected to said finger-like radiating abutment portions. When thusly operatively connected, the relatively upper housing section 126 and the relatively lower housing section 128 are sealed against each other as by an intermediate elastomeric O-ring seal 150 which is guidingly received as in an annular groove or recess 152.

A portion of the outer-upper housing 126 is formed as to define a generally inverted "U"-shaped opening 154 as to closely avoid dimensionally interfering with tubular or conduit portion 112.

With the housing sections 126 and 128 assembled as depicted in FIG. 2, a spool member 156, preferably comprised of nylon and having a cylindrical passage 158 defined by a cylindrically tubular wall 160. Axial end walls 162 and 164, generally formed with tubular wall 160, radiate outwardly and serve to axially contain therebetween the winding or coil 166 carried annularly on and about the tubular wall 156.

A generally cylindrical core or pole piece 168 is shown as having a reduced diameter cylindrical extension 170 provided with a tool slot 172 effective for operative engagement with associated tool means. The other axial end of pole piece cylindrical body 169 carries a threaded extension portion 174 which is in threaded engagement with an internal threaded portion 176 of an annular or inner ring-like member 178, so as to present projecting end 175 a calibrated distance from armature 232. Preferably, member 178 is formed of material which does not conduct magnetic flux.

Figure 15:
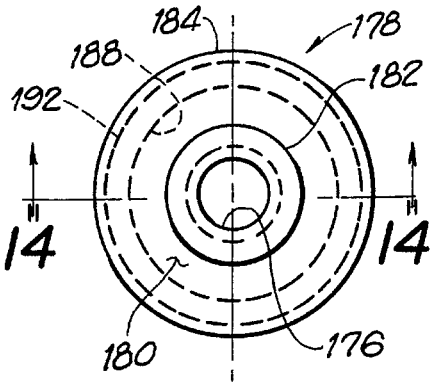
FIG. 15 is a view taken generally on the plane of line 15—15 of FIG. 14 and looking in the direction of the arrows.
Figure 14:
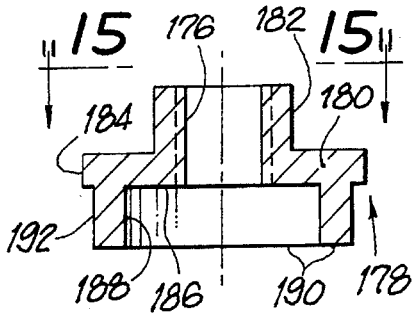
FIG. 14 is an axial cross-sectional view of still another element shown in FIG. 2 and may also be considered as a cross-sectional view taken generally on the plane of line 14—14 and looking in the direction of the arrows.

FIGS. 14 and 15 illustrate annular member 178 as comprising a generally annular main body portion 180 with a centrally disposed cylindrical extension 182 having the internal thread 176 formed therethrough. Preferably, the main body portion 180 is formed with a right cylindrical periphery 184.

As shown in both FIGS. 14 and 15 (as well as in FIG. 2) a cylindrical recess 186 is formed as in the lower portion of annular member 178 thereby defining the inner cylindrical surface 188 of the shown downwardly depending cylindrical wall 190. As possibly best seen in FIGS. 14 and 15, the cylindrical wall 190 is formed as to have its outer cylindrical surface 192 a selected distance radially inwardly of the outer periphery 184.

Figure 13:
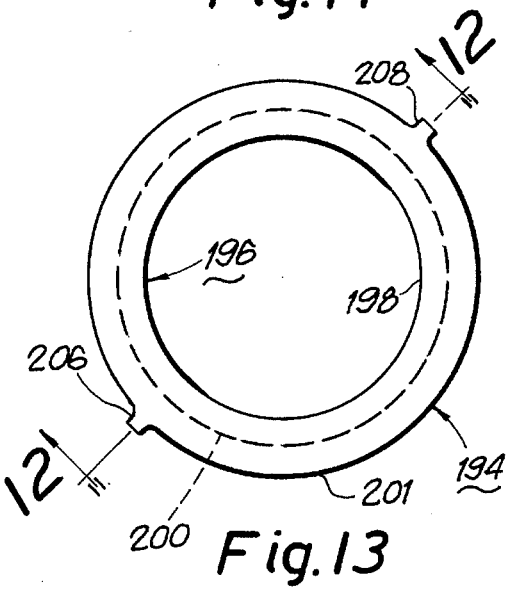
FIG. 13 is a view taken generally on the plane of line 13—13 in FIG. 12 and looking in the direction of the arrows.
Figure 12:
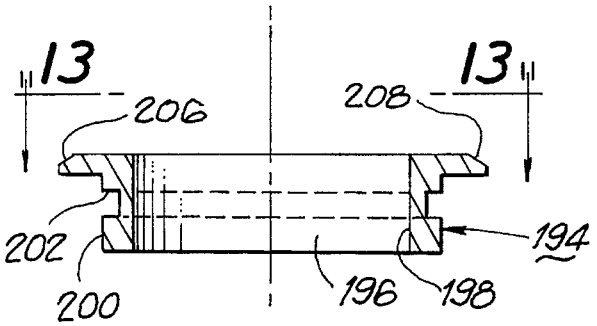
FIG. 12 is an axial cross-sectional view of another of the elements shown in FIG. 2.

A ring-like radially outer core member 194, shown in FIG. 2, is shown in greater detail in FIGS. 12 and 13. The core member 194 is of a generally ring-like configuration and is preferably comprised of a material which does conduct magnetic flux such as, for example, cold rolled steel. A central opening or passage 196 is of a diametrical dimension which, preferably, enables the threaded member 178 to be press-fitted therein whereby the outer cylindrical surface 184 is made into an interference fit with cylindrical surface 198 which defines the passage 196.

The outer cylindrical surface 200, which comprises an annular groove 202 for receiving and/or locating an O-ring seal 204 (FIG. 2), is preferably closely received in and against the cylindrical surface 136 of lower housing section 128.

Figure 11:
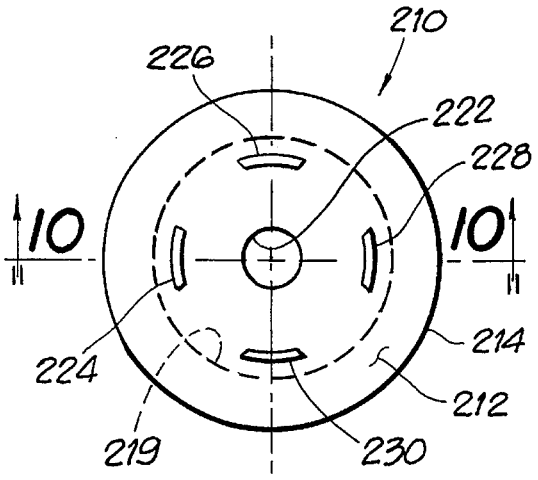
FIG. 11 is a view taken generally on the plane of line 11—11 of FIG. 10 and looking in the direction of the arrows.
Figure 10:
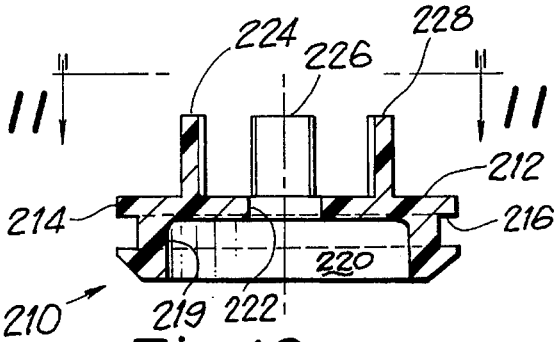
FIG. 10 is an axial cross-sectional view of another of the elements shown in FIG. 2 and, further, may be considered as a cross-sectional view taken on the plane of line 10—10 of FIG. 11 and looking in the direction of the arrows.

A valve seat member 210 of FIG. 2, also shown in FIGS. 10 and 11, has a main body 212 which has an outer cylindrical surface 214 with an annular recess 216 for the reception and/or location of a suitable O-ring seal 218. Preferably, body 212 is provided with a counterbore or chamber 220 formed as by a cylindrical wall 219 and which communicates with a passage 222. In the preferred embodiment, generally upstanding guide members or portions 224, 226, 228 and 230 are integrally formed with valve seat body 212. Although the valve seat member 210 may be formed of any suitable material, in the preferred embodiment the valve seat member 210 is comprised of nylon.

FIGS. 2, 6, 7, 8 and 9 depict first and second armatures 232 and 234. That is, in the preferred embodiment a plurality of armature means are provided for, at different operating conditions, varying the rate of flow permitted through passage 222 of valve seat member 210.

Figure 6:
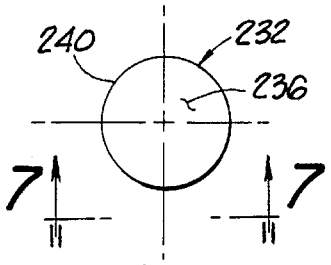
FIG. 6 is a top plan view of one of the elements shown in FIG. 2.
Figure 7:
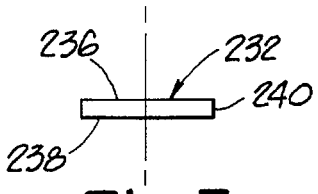
FIG. 7 is a view taken generally on the plane of line 7—7 of FIG. 6 and looking in the direction of the arrows.

FIGS. 2, 6 and 7 depict, in the preferred embodiment, a disc-like armature valving member 232 having, preferably, opposite generally flat faces 236 and 238 as well as a cylindrical outer periphery 240.

Figure 8:
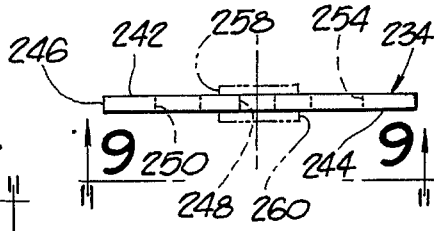
FIG. 8 is a side elevational view of another one of the elements shown in FIG. 2.
Figure 9:
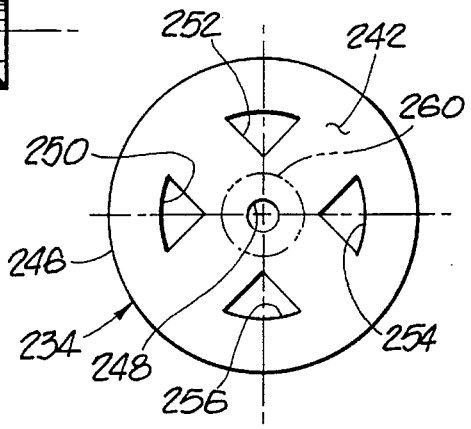
FIG. 9 is a view taken generally on the plane of line 9—9 of FIG. 8 and looking in the direction of the arrows.

FIGS. 2, 8 and 9 depict, in the preferred embodiment, a second disc-like armature valving member 234 having, preferably, opposite generally flat faces 242 and 244 as well as a cylindrical outer periphery 246. A centrally located passage 248 is formed through armature 234. As best shown in FIG. 9, a plurality of additional clearance type passages or openings 250, 252, 254 and 256 are formed therethrough and such openings freely respectively receive therethrough the upstanding guide portions 224, 226, 228 and 230.

A plurality of elastomeric sealing members 258 and 260 are preferably provided and, further preferably, operatively secured to opposite sides of armature 234 as by suitable adhesive or cement means or actually molded onto the armature 234 in a manner whereby respective central apertures 262 and 264 are aligned and permitting, preferably, aperture 248 of armature 234 to be the controlling flow passage.

Generally, the embodiment of FIG. 2 could be assembled by placing valve seat member 210 and O-ring 218 into the lower housing 128 assuming a position as that generally depicted in FIG. 2. Armature 234 and elastomeric members or portions 258 and 260 are placed onto the valve seat member 210 by passing the valve seat member guides 224, 226, 228 and 230 respectively through the clearance apertures 250, 252, 254 and 256. Thereafter, the other armature 232 is placed as atop elastomeric member 258 and generally within the central confines of guides 224, 226, 228 and 230.

The inner annular member 178, FIGS. 14 and 15 and the outer annular core 194 are axially pressed together as to attain a pressed-to-each-other relationship as depicted in FIG. 2. A first spring 270 is placed operatively above and against armature 232 while a second compression coiled spring 272 has one end placed in the annular clearance between surface 198, of outer annular core 194, and the juxtaposed surface 192 of inner annular member 178.

The pressed assembly of outer core 194 and the inner annular member may then be axially moved into assembly with the lower housing section 128 with such being determined as by the annular flange radially extending from 200 to 201. At this time, it will be noted that the finger-like latch portions 206 and 208 will each be extending radially beyond the cylindrical surface 151 (FIG. 4).

Next, the spool 156 and field winding 166 may be placed atop the previously assembled inner and outer rings 178 and 194 and as to be generally piloted by cylindrical extension 182 of inner annular member 178.

The core or pole piece 168 is provided with an O-ring like seal 280, which may be situated as in an annular groove (not shown) formed in and about the body 169. The seal 280 operatively engages the surface of passage 158 to prevent any flow past such seal 280.

A suitable tool is operatively engaged with slot 172 and the pole piece 168 is rotated causing the threaded portion 174 to axially move pole piece 168 with respect to inner annular member 178. In the preferred embodiment suitable means are provided as to cause said threads 176 and 174 to be in effect locked to each other once the proper axial position of pole piece 168 is attained.

A generally inverted U-shaped metal strap 290 is placed onto the bobbin 156 as to have depending legs 292 and 294, each joined to a bight portion 296, and respectively having notches 298 and 300 formed through the legs at the lower ends thereof. As best seen in FIG. 2, once the strap-like member 290 becomes seated as depicted, the legs 292 and 294 have ridden over the extending finger-like portions 206 and 208 resulting in such fingers 206 and 208 being respectively received in openings or notches 298 and 300 so that the lower surfaces of fingers 206 and 208 serve as abutments against the lower surfaces of respective openings 298 and 300. The strap-like member is conductive of magnetic flux and is, preferably, comprised of zinc coated cold rolled steel.

As best seen in FIG. 2, the strap-like member 290 has formed, as at its upper end, a pair of arm-like portions 302 and 304 which, at opposite sides, engage the extension 170 of pole piece 168. Such engagement provides a more efficient path for magnetic flux. Also, the force presented by portions 302 and 304 against extension 170 may be such as to result in such engagement providing at least some resistance to pole piece 168 and extension 170 rotating out of their selected adjusted position.

Finally, the outer housing 306 is assembled to and operatively connected as by the cooperative action of arm-like extensions 140, 142 and 144 and cooperating openings as 146 and 148. Arm-like extension 142 is depicted in FIG. 5, but not shown in either FIGS. 1, 2 or 4. Similarly, cooperating opening 148 is depicted in FIG. 1 but not otherwise shown and opening 146 is depicted in FIG. 2 but otherwise not shown.

When the outer housing 306 is in the process of being assembled to the remainder of the structure an electrical contact 308 carried as by the upper extension 310 of housing 306 is electrically connected as to one of the terminal leads 312 of the winding 166. Similarly, a second electrical contact 314, also carried generally in the upper extension 310, is electrically connected as at 316 to a second terminal lead 318 of the winding 166. Suitable male type plug-in means, well known in the art, is effective for operatively electrically engaging the terminal contacts 308 and 310. For purposes of discussion it may be assumed that such male electrical plug is comprised of conductor means 94 and 96, shown in FIG. 1, with conductor 94 being in circuit with, for example, terminal 314 (FIG. 3) and terminal 308 being in circuit with 96.

As should now be apparent, the function of the solenoid assembly 108 is to convert a pulse width modulated (PWM) signal to a flow rate of fuel vapors. The fuel vapors are stored in the fuel vapor canister 116 and are recycled into the engine 10 for combustion. The PWM signal is generated by the vehicle electronic control unit (ECU) and is the result of a purge control algorithm based upon such things as, for example, throttle valve position, mass air flow to the engine, exhaust gas oxygen sensor output and related fuel injector calculations. The invention, as already disclosed, is capable of finely metering fuel vapors under high engine intake manifold vacuum at low precent duty cycles for idle engine purge and providing high flow rates for such fuel vapors at low manifold vacuums and high percent duty cycles for rapid canister purge.

The solenoid assembly of the invention is constructed with a three-piece core, two disc type movable armatures, 232 and 234 and a frame 290 around the coil winding. The magnetic lines of force created by the electric current in the coil 166 react to close the gap between the armatures and core. The magnetic permeability of the armature, core, and frame dictate the efficiency of the solenoid. Current passing through the helical coil winding of closely spaced turns of copper magnet wire produce a magnetic field which surrounds the coil. When the steel frame 290 is assembled around the winding 166 it attaches to the cores outer ring 194 and makes contact with the calibration core piece 168, 170, so the magnetic force is channeled through the metal and is considerably increased because of the magnetic permeability of the steel as compared to that of air.

The invention as already herein disclosed employs a single coil 166 with two disc type armatures 232 and 234 with sealing features 258 and 260. Disc armature 232 seals off a relatively small diameter orifice or passage in disc armature 234 thereby providing fine flow metering at low percent duty cycles. At this lower duty cycle the only armature operating is armature 232. Disc armature 234 is used to seal off a larger diameter orifice 222 in the valve seat 128 to provide increased flows at high percent duty cycles. At this higher duty cycle both armatures are operating in conjunction with each other. The disc armatures 232 and 234 are held in the closed position (providing zero flow) by independent compression springs 270 and 272 and are opened by the cores 168, 174 and 194 and magnetic attraction induced by energizing coil 166. The cut-in point, where armature 232 begins to operate and the cut-over point where armature 234 begins to operate, of the disc armatures are controlled by their distance from the core and the compression spring force. This distance and spring force can be changed to vary the cut-in and/or cut-over operating characteristics. The distance from armature 232 to the core 175 is adjustable to provide better control and flexibility of the cut-in point. The movable armatures are held in position and centered on the coil winding 166 by guides 224, 226, 228 and 230 on the valve seat 210 which can be made of either non-magnetic metal or plastics material.

To provide the critical flux paths to the two armatures 232 and 234 the core or pole piece means is preferably a three piece unit comprising a central calibration core 168 of magnetic material, an inner ring-like member 178 of non-magnetic material and an outer ring or annular member 194 of magnetic flux conducting material. As already described, the inner 178 and outer 194 core rings are press-fitted together and the calibration core 168 is threaded into the inner ring 178. A sealant or tapered thread, 174 and/or 176, can be used to keep the calibration core 168 from moving from its selected calibrated position. The magnetic calibration core 168 and outer ring 194 help concentrate the magnetic flux lines at the critical areas of the armatures 232 and 234 while the non-magnetic inner ring 178 provides for a more efficient flux line path.

OPERATION OF THE PREFERRED EMBODIMENT

FIGS. 1, 2, 3, 4, 5, 6, 7, 8, 9, 10, 11, 12, 13, 14 and 15

When the vehicular engine 10 is shut-down and the associated vehicle is at rest, there is no fuel flow into the divider 64 (FIG. 1), the ECU 70 is at rest and non-operating, and the direct current source 98 is also shut-down.

The fuel vapor canister 116 may be considered as being filled or nearly filled with fuel vapors. If any such fuel vapors should travel along conduit or passage 122 (FIG. 1) and into chamber 322 (FIG. 2), the vapor will not flow out via conduit means 110 because of armatures 232 and 234 effectively closing flow through passage 222.

It should be made clear that the overall performance of the valving means 108 can be varied by proper selective calibration to achieve desired flow characteristics as well as the time or relative time that such selected flow characteristics are made to be functioning.

For example, let it be assumed for purposes of discussion, that at complete engine shut-down, as previously referred to and described, the vapor flow from 116 and 122 to and through valving means 108 and via 110 to induction passage means 24 is effectively, zero. This condition could be represented as by point 600 on the curve of the graph of FIG. 16.

Now, let it be assumed that the vehicular engine 10 is started and is operating at, for example, curb idle engine operation. This condition could be represented as by point 602 on the curve of the graph of FIG. 16. This would be achieved by the ECU 70 causing the power source 98 to increase the % duty cycle as to 20%. This would (or could) increase the magnetic attraction between 175, of pole piece means 168, and armature 232, causing the armature 232 to start to move against spring 270 and away from the passage comprised of passage sectors 264, 262 and 248.

Normal road load engine and vehicle operation may be represented by the curve between and including points 602 and 604. By way of illustration, point 604 is shown at a flow rate of 6.0 liters per minute (to induction passage 24) and at approximately a 68% duty cycle. The increase in percentage of duty cycle, that is, from 20% duty cycle to 68% duty cycle, is brought about by ECU 70 responding to changing magnitudes of inputs to ECU 70.

As is generally known, the greater the percentage duty cycle, the longer is the total time that coil 166 is energized for a given span of time. Therefore, as the duty cycle is increased the greater or longer is the total time that the first armature-valve 232 is in an open position with respect to passage sectors or portions 262, 248 and 264. Consequently, the greater is the rate of flow of fuel vapors from canister 116, through conduits 122, 112, chamber 322, passage 110 and into the induction passage 24 from where it flows to the combustion chambers of the engine 10.

As should now be apparent, the performance curve, for example from 602 to 604, can be varied from that as depicted. That is, the pole piece means 168 may be adjusted as to bring end 175 closer to the valving armature 232 and thereby vary the responsiveness of armature 232 to the cyclic energization of the field coil 166. Also, another factor in determining the opening and closing action of armature 232 is the preload and spring rate of spring means 270. Therefore, it should be evident that the performance curve as from 602 to 604 may be selectively altered to achieve characteristics as desired for any particular vehicle and engine.

Still, for further disclosure, let it be assumed that in the disclosed vehicle, it is desired that upon engine deceleration there be a rapid increase in the rate of flow of fuel vapors from canister 116 to the engine 10 for burning therein. As should be apparent, and as employed in the prior art atmospheric filter and inlet means, as depicted at 114, the ambient atmospheric inlet and filter means 114 serves to let atmospheric air flow into canister 116 when the flow out of canister 116 is initiated and continued.

The assumed high rate of fuel vapor flow is shown as existing between points 604 and 606. This relatively high rate is effectively brought about by the relatively high engine manifold vacuum during engine deceleration and the fact that the programed increase in percentage of duty cycle was made to increase from 68% duty cycle to point 606 which is located at 28 liters per minute and effectively 100% duty cycle. This, in effect occurs because the inputs to ECU 70 and DC source 98, at point 604 are such as to significantly increase the magnetic attraction exhibited by outer magnetic flux conducting ring 194 toward the second valve-armature 234. The flux in ring 194 is sufficient to start armature 234 moving upwardly thereby (as with annular elastomerics 258 and 260) effectively progressively increasing the opening to flow of fuel vapors through passage 222 and via 110 to the intake of the engine 10 for burning therein.

Figure 16:
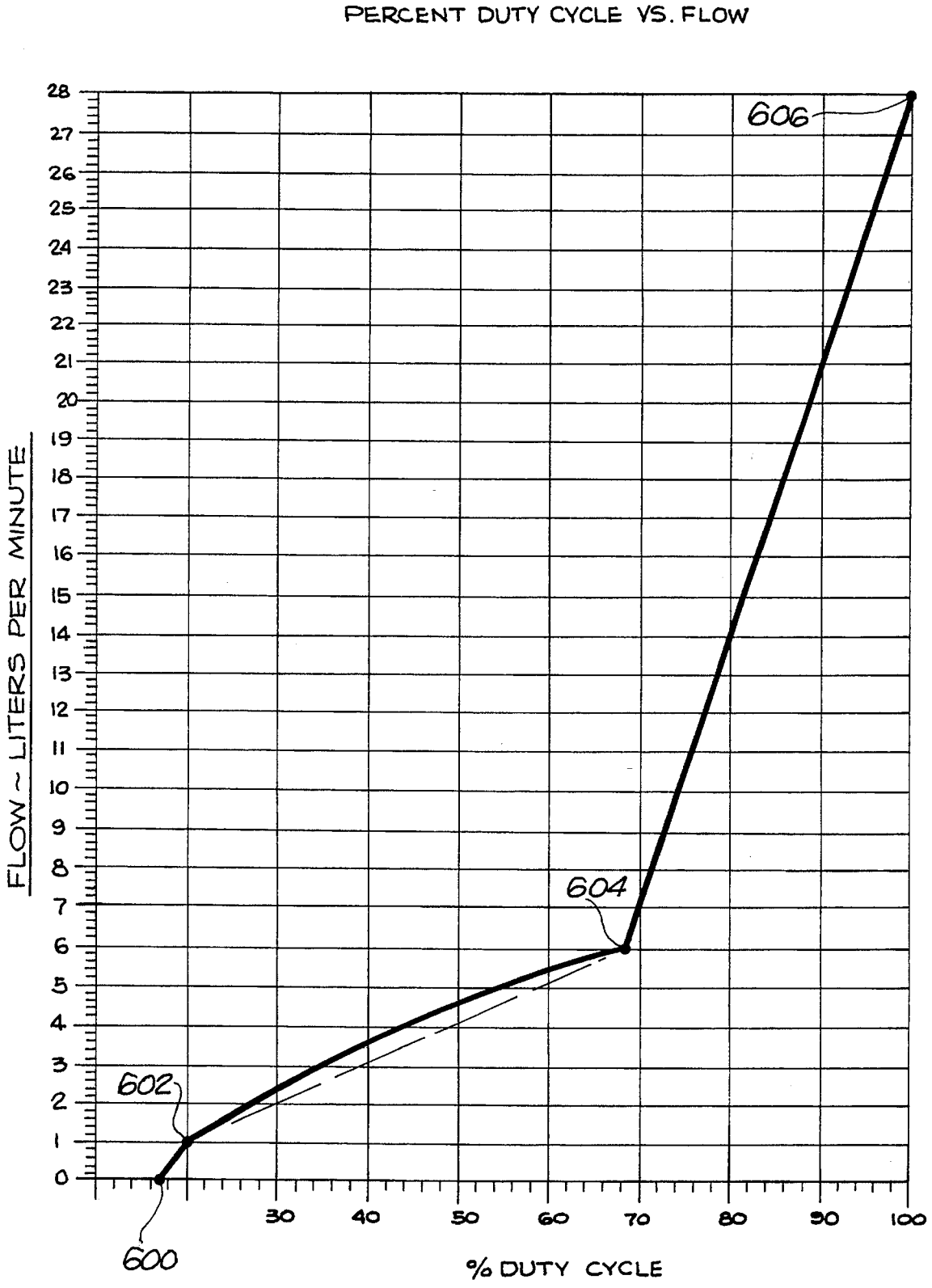
FIG. 16 is a graph depicting, by way of example, the relationship of the purge flow fuel vapors, or fluid, in terms of liters per minute plotted against the percent of duty cycle of the assemblies of FIGS. 2, 17 or 18.

In reviewing FIG. 16, it can be seen that the invention as disclosed is capable of providing at least two distinct rates of flow of fuel vapors from the fuel vapor canister 116 and into the engine induction passage for burning in said engine.

Figure 17:
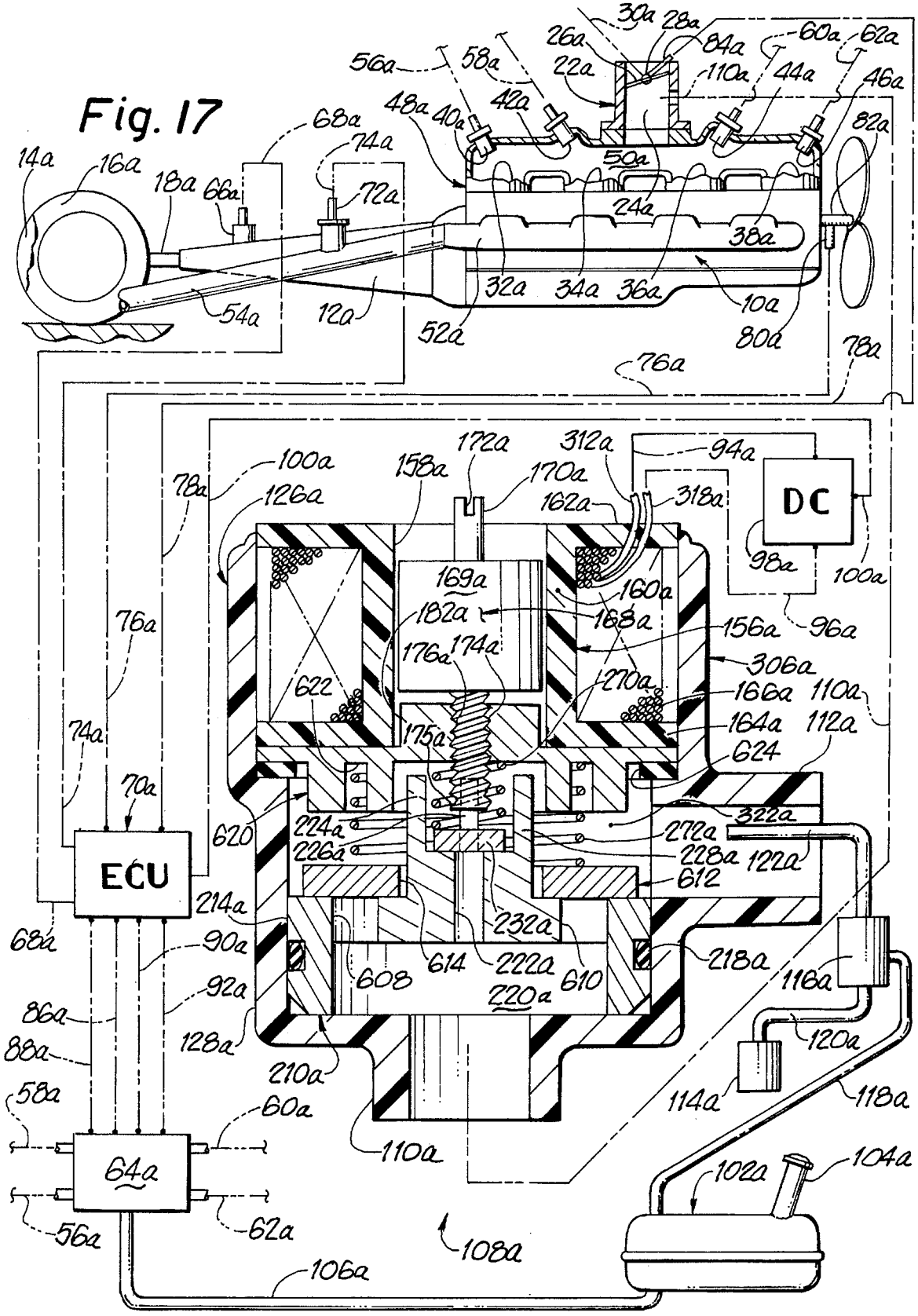
FIG. 17 is a view similar to that of FIGS. 1 and 2 but illustrating an other embodiment of a solenoid assembly employing teachings of the invention.

FIG. 17 discloses a modification of the invention of FIGS. 1–16. In FIG. 17, all elements which are like or similar to those of any of the elements in FIGS. 1–15 are identified with like reference numbers provided with a suffix "a".

Referring in greater detail to FIG. 17, the valve seat member **214*a* is provided with a plurality of passages, two of which are shown at 608 and 610. The generally central portion of seat member 214*a* not only carries the guide portions, such as 224*a*, 226*a* and 228*a* (230*a* which would correspond to 230 of FIG. 11, not being shown) but also serves as a piloting portion for aperture 614 of armature 612. In the preferred embodiment, armature 612 is of a ring-like configuration and, when in the depicted position, serves as a valving member whereby valve-armature 612, when seated, is effective to close off any flow through the plurality of passages exemplified by 608 and 610**.

In the embodiment of FIG. 2 the assembly comprised of 178 and 194 is, in FIG. 17, effectively replaced by the single annular member 620 which has an annular recess 622 formed therein to receive and serve as a seat for compression spring **272*a*. In the embodiment of FIG. 2, the annular recess, functionally equivalent to 622, is formed by the coaction of members 178 and 194. Further, unlike member 178, of FIG. 2, which is preferably comprised of magnetic flux non-conducting material, the entire member 620 is preferably comprised of magnetic flux conducting material. Member 620 is preferably urged against an annular seal 624 effectively sealing the area above member 620 from chamber 322*a***.

As already generally described with reference to FIGS. 1 and 2, when preselected conditions of engine and/or vehicle operation are attained, the magnetic attraction of the flux through threaded portion **174*a*, of the pole piece means 168*a*, 620 and 174*a*, causes the primary or first valve-armature 232*a* to be moved, against spring 270*a* and in the opening direction. The degree of opening is of course related to the chosen selected calibration. In any event, to whatever degree valve-armature 232*a* is opened, to that degree fuel vapor flows from canister 116*a* via conduit means 122*a* to chamber 322*a* and from there past the at least partially open valve-armature 232*a*, through passage 222*a* through chamber 220*a* and, via conduit means 110*a*, to engine induction passage means 24*a* for burning with the engine 10*a***.

Generally, if it is assumed that with continued engine and vehicle operation, the ECU **70*a* causes increases in the percentage of duty cycle, the magnetic attraction between 175*a* and valve-armature 232*a* increases causing valve-armature 232*a* to be more fully opened (in the manner generally described with reference to FIGS. 2 and 16) and thereby increasing the rate of flow of fuel vapor from canister 116*a*, through passage 222*a*, conduit 110*a* and into induction passage 24*a***.

Let it be assumed that the valve-armature **232*a* has reached or is about to reach a maximum opened position and that the engine and/or vehicle operation is such that the signals coming into the ECU 70*a* are such as to require an even increased fuel vapor flow to the induction passage 24*a*. This comes about through an increase in the percentage of duty cycle thereby resulting in an increase in the magnetic attraction between stationary pole piece means 620 and ring-like valve-armature 612. As the magnetic attraction continues to increase, the ring-like valve-armature 612 moves further in the opening direction, against spring 272***a*, allowing flow of fuel vapor to occur through the multiple passages as depicted by 608 and 610. The fuel vapor, as before, flows via conduit means 110*a* to induction passage means 24*a* for burning within engine 10*a*. As should be apparent, the slopes or rates of flow of the fuel vapor for the flow permitted via 222*a* and for the flow permitted via 608, 610 along with 222*a* can be made to be substantially different from each other as depicted, by way of example, in FIG. 16.

Figure 18:
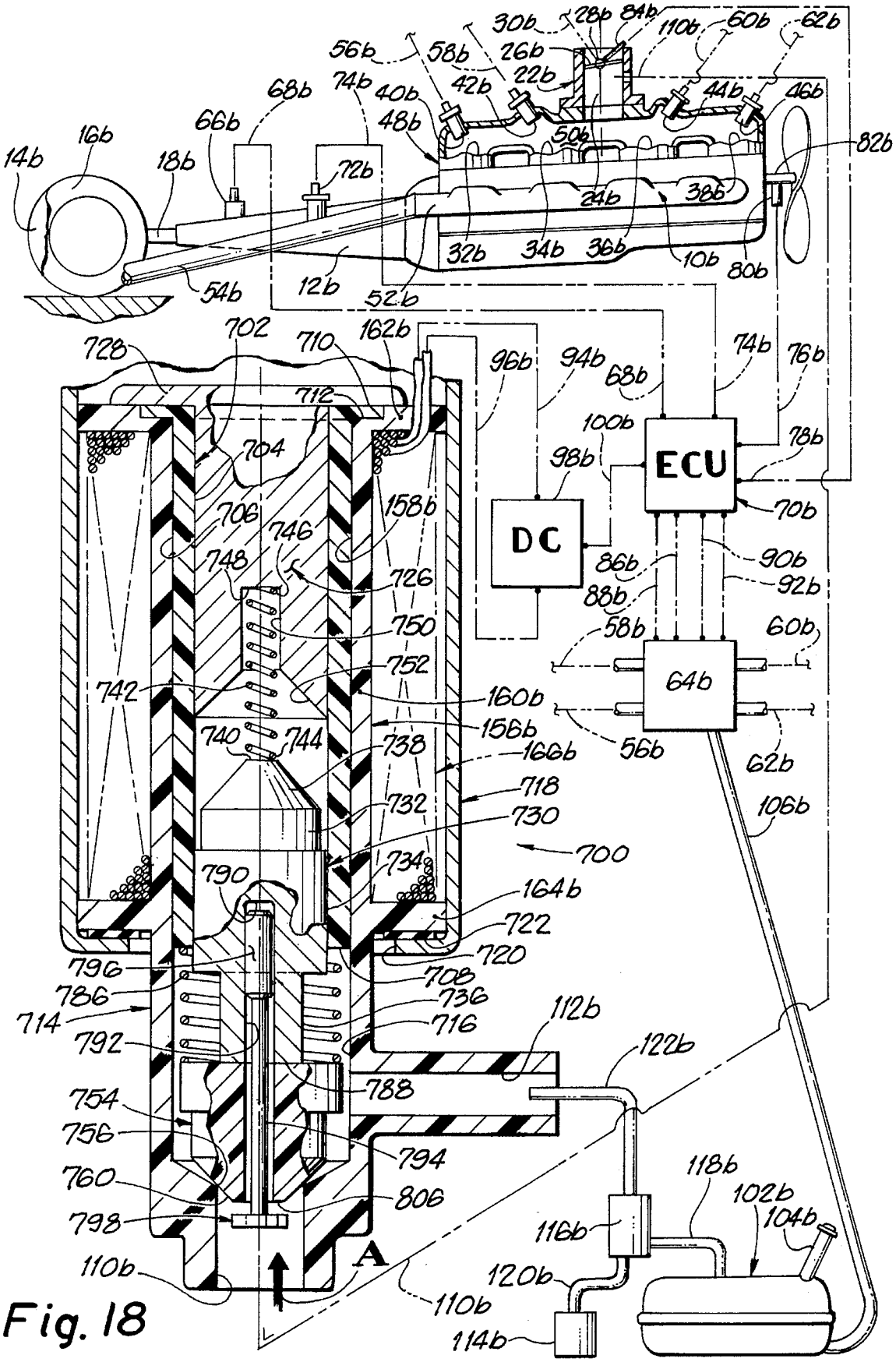
FIG. 18 is a view similar to that of either FIG. 1 or 17 but illustrating an other embodiment of a solenoid assembly employing teachings of the invention.

FIG. 18 discloses a still further embodiment of the invention. All of those elements in FIG. 18 which are like or similar to any of the elements of FIGS. 1–16, except as noted to the contrary, are identified with like reference numbers provided with a suffix "b".

Referring in greater detail to FIG. 18, the solenoid valving assembly 700 is depicted as comprising a cylindrically tubular inner member 702 having an inner cylindrical surface 704, an outer cylindrical surface 706, a lower (as shown) axial end 708 and, preferably, an upper (as shown) outwardly radiating flange 710 which, again preferably, is received in a cooperating annular recess 712 in an upper outwardly radiating end wall 162*b* of the spool 156*b*. The winding 166*b*. is about the central tubular portion 160*b* and axially contained between radiating end walls 162*b* and 164*b*. In the preferred embodiment, the outer cylindrical surface 706 and the cooperating inner cylindrical surface 158*b* are of respective dimensions as to at least bring such surfaces 706 and 158*b* into very close juxtaposition to each other.

In the depicted embodiment, a body like portion 714 is made integral with spool means 156*b*. as to generally depend therefrom as depicted in FIG. 18. A generally cylindrical-like chamber 716 is formed therein and, at least at times, communicates with passage or conduit means 110*b* and 112*b*.

In the preferred embodiment the assembly 700 comprises a suitable outer generally tubular housing 718 which, at its shown lower end 720 is formed radially inwardly as thereby sealingly contain an annular seal 722 between 720 and spool end wall 164*b*.

The upper end of outer housing 718 is depicted as broken away in that such could be made in any of a plurality of configurations. Further, in the preferred embodiment, the main axially extending body 724 of a pole piece means 726 is at least closely received with respect to inner cylindrical surface 704. In the preferred embodiment, the upper end of pole piece 726 is provided with an integrally formed annular abutment portion 728 which preferably axially abuts against radially extending wall portion 162*b* and abuts against radially extending wall portion 710.

A generally cylindrical armature means 730, slidably contained within inner cylindrical surface 704, preferably comprises cylindrical portions of stepped diameters 732, 734 and 736 along with an upper conical end 738 which, preferably has a flat end surface 740. A compression spring 742 has one end 744 seated as against end surface 740 and its other end 746 seated as against an axial end surface 748 of a counterbore-like chamber 750. Preferably, the shown lower axial end of pole piece 726 is formed with a generally concave conical surface 752 substantially matching axially juxtaposed surface 738.

A secondary armature-actuated member or valve 754 is shown sealingly seated on a valving seat 756 effectively surrounding conduit or passage 110*b*.

Figure 19:
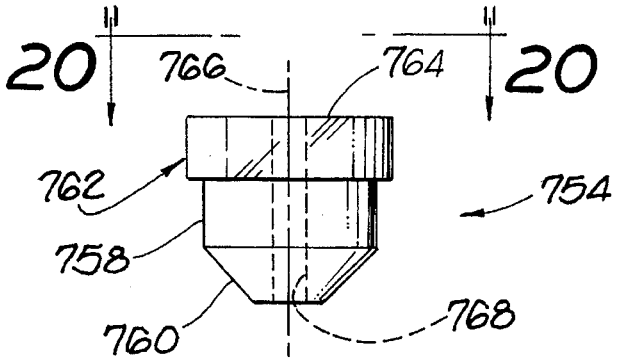
FIG. 19 is a side elevational view of one of the elements shown in FIG. 18.
Figure 21:
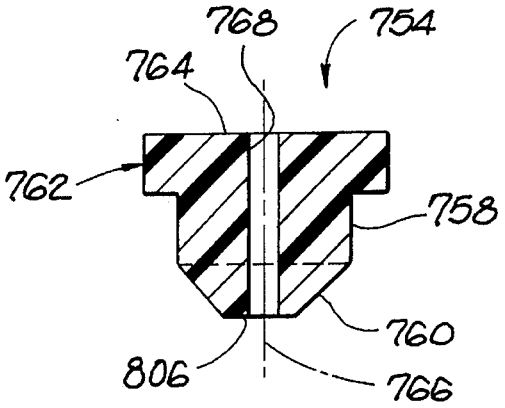
FIG. 21 is a cross-sectional view taken generally on the plane of line 21—21 of FIG. 20.
Figure 20:
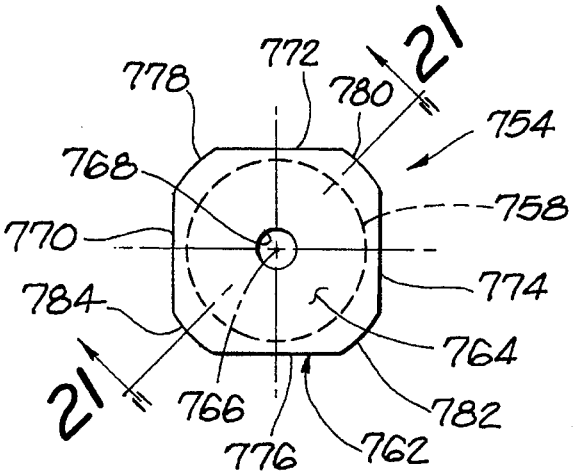
FIG. 20 is a view taken generally on the plane of line 20—20 of FIG. 19 and looking in the direction of the arrows.

FIGS. 19, 20 and 21 illustrate the valving member 754 in greater detail. As best seen in FIGS. 19 and 20, an axial mid-portion of the valving member 754 is preferably of cylindrical configuration 758 and, at its lower end, continues as a converging conical surface 760. In the preferred embodiment, the shown upper end of cylindrical body portion 758 is formed with a head-like or guide-like portion 762. The head-like portion 762 may be provided with a substantially flat upper surface 764 which is intersected, at a right angle, by the axis 766 of a centrally situated through passage 768.

In the preferred embodiment of the valving member 754 the head-like portion 762 is formed to have four generally flat side surfaces 770, 772, 774 and 776 which are effectively serially joined or continued by arcuate surfaces 778, 780, 782 and 784. The diametrical dimension as from 778 to 782 and as from 780 to 784 is close to and piloted within passage 716. The flat sides 770, 772, 774 and 776 provide for the free flow of fluid therepast. In the preferred embodiment, the valving member 754 is comprised of a plastics material such as, for example, nylon.

As depicted in FIG. 18, a coiled compression spring 786 is operatively abutted against both end 708 of tubular member 702 and end surface 764 of valving member 754 thereby normally resiliently holding member 754 sealingly seated on sealing seat 756. A second resilient force is provided via spring or elastomeric means 742 which also urges the valving member 754 into its seated and sealed condition by applying the resilient force against surface 740 and thereby, axially through armature 730 apply such resilient force against valving member 754. The application or transfer of force from armature 730 to valving member 754 is brought about by transverse axial end surface 788 abutting against surface 764 of valving member 754.

Figure 22:
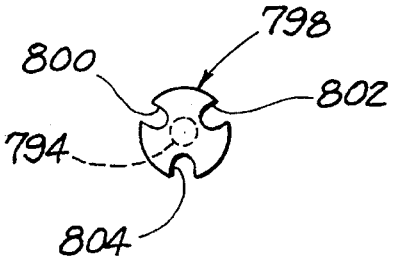
FIG. 22 is a view taken of one of the elements in FIG. 18 taken generally in the direction of arrow A in FIG. 18.

Referring to FIGS. 18 and 22, the armature 730 is provided with a closed end 790 and passage 792 which opens in surface 788. The valving member 754 has its passage 768 in general alignment with passage 792. An elongated actuating means or rod 794 extends through passage 768 and into passage 792. The shown upper portion 796 of the actuating rod 794 may be press-fitted into passage 792 or threadably secured in the passage 792 by having portion 796 externally threaded and threadably engaged with a cooperating juxtaposed portion of passage 792.

The outer most end of actuating rod 794 carries an abutment-like portion 798 which may be integrally formed with the remainder of actuating rod 794 or operatively secured thereto.

FIG. 22 is an elevational view of abutment 798 taken generally in the direction of arrow A of FIG. 18.

In the embodiment disclosed, the abutment portion 798 may be of generally cylindrical disc-like configuration having a plurality of openings, passages or clearances 800, 802 and 804. The entire abutment 798 is suitably and functionally carried and secured to the shaft-like portion 794.

In situations when abutment 798 is brought against the lower open end 806, the body of abutment member 798 may physically abut against the lower (shown) end of valving member 754 but flow as between passage 768 and conduit or passage 110*b* is not terminated or reduced because of the openings, passages or clearances 800, 802 and 804.

The embodiment of FIG. 18 comprises a single coil or winding 166*b*. and having an armature 730 and armature - actuated member 754 with sealing features. When the elements are in their respective positions shown in FIG. 18 any otherwise possible communication between the upper end of passage 768 and passage or conduit 112*b* is precluded by end 788 of armature 730 being sealingly seated upon surface or face 764. This condition could be considered as existing at engine shut-down and, in effect could correspond to point 600 in the graph of FIG. 16.

Assuming now that the engine 10*b* is started and is operating at, for example, curb idle conditions the ECU 70*b* along with selected indicia of engine and/or vehicular operation may be selected as to cause the armature means 730 to respond to the generated duty cycle as, on an average, be selected axially closer to the pole piece 726. This then permits a fine or very limited flow of fuel vapor to flow as between end surface 788 and juxtaposed surface 764 and, through the axially extending space as between stem 794 and surrounding passage 768. This condition could be considered as being represented as by point 602 of the graph of FIG. 16.

At a comparatively higher duty cycle the oscillating movement of 730 and 754 may be such as to cause the seat 756 to become somewhat opened. The upward movement of member 754 is brought about by member 730 (because of the generated flux) moving toward pole piece 726 and, through motion transmitting rod 794, move member 754 some distance upwardly (toward pole piece 726). Such a higher duty cycle could bring a flow, through conduit 122*b*, into and through 112*b*, into chamber 716, and through passage or conduit 110*b* leading to the induction passage means 24*b*. Such a flow of fuel vapor at such an assumed condition could be represented as by 604 in the graph of FIG. 16.

At a comparatively still higher duty cycle the oscillating movement of 730 and 754 may be such as to cause the seat 756 to become somewhat, comparatively, further opened. The upward movement of member 754 is brought about by member 730 (because of the generated flux) moving toward pole piece 726 and, through motion transmitting rod 794, move member 754 some distance upwardly (toward pole piece 726). Such a still higher or further increased duty cycle would bring a still increased flow, through conduit 122*b*, into and through 112*b*, into chamber 716 and through passage or conduit 110*b* leading to the induction passage means 24*b*. Such a flow of fuel vapor at such an assumed condition could be represented as by 606 in the graph of FIG. 16.

Although only a preferred embodiment and a limited number of modifications and other embodiments of the invention have been disclosed and described, it is apparent that other embodiments and modifications of the invention are possible within the scope of the appended claims.

What is claimed is:

1. The combination of an internal combustion engine having a combustion chamber, induction passage means for communication with said combustion chamber, canister means for receiving and at least to some degree storing fuel vapor of the fuel employed by said engine, valving means functionally generally between said canister and said induction passage means, said valving means being effective to control the flow of said fuel vapor from said canister to said induction passage means, said valving means comprising a first valving member effective upon opening to permit first rates of flow of said fuel vapor from said canister to said induction passage means, said valving means further comprising a second valving member effective upon opening to permit therethrough second rates of flow of said fuel vapor from said canister to said induction passage means, wherein said first rates and said second rates differ from each other in that the change in quantity of flow of said fuel vapor according to said first rates changes less for each unit of change in the effective flow area of said first valving member than the change in quantity of flow of said fuel vapor according to said second rates for changes in the effective flow area of said second valving member which are substantially equal to the changes of said first valving member, wherein said first valving member is effective to open and close a first valve passage, wherein said second valving member is effective to open and close a second valving passage, wherein said first valve passage comprises a first effective flow area, wherein said second valve passage comprises a second effective flow area substantially greater than said first effective flow area, and wherein said first and second valve passages are in series flow relationship to each other.

2. A solenoid operated valving assembly, comprising a bobbin, said bobbin comprising a generally central cylindrical axially extending tubular portion, a first generally annular outwardly radiating end wall carried by said tubular portion, a second generally annular outwardly radiating end wall carried by said tubular portion, said first and second end walls being axially spaced from each other, an electrical coil carried about said cylindrical axially extending tubular portion and axially contained generally between said first and second end walls, a pole piece situated generally within said axially extending tubular portion, housing means for the general containment therein of said bobbin with said electrical coil and said pole piece, a chamber formed generally between one end of said housing means and said second end wall, a first conduit carried by said housing means and at one end in communication with said chamber, a second conduit carried by said housing means and at one end being effective for communicating with said chamber, a body carried within said chamber and provided with a first flow passage formed therthrough whereby said first flow passage is in communication with said second conduit, a first armature situated in said chamber as to be acted upon by said pole piece, said first armature comprising a second flow passage formed therethrough, said first armature being normally positioned as to have said second flow passage in communication with said first flow passage, a second armature normally positioned as to close said second flow passage to any flow therethrough, wherein said second armature is normally positioned as to also be relatively close to said pole piece, resilient means effective for resiliently urging said first armature toward operative engagement with said body carried within said chamber and effective for resiliently urging said second armature toward operative closing engagement with said first armature, wherein when said electrical coil is energized to a first extent the magnetic flux through said pole piece is sufficient to cause said second armature to at least start to move away from said first armature and thereby establish at least a minimal fluid flow path as among and through said second and first conduits and through said first flow passage and said second flow passage, and wherein when said electrical coil is energized to a second extent greater than said first extent the magnetic flux through said pole piece is sufficient to cause said first armature to at least start to move away from said body carried within said chamber and thereby increase the effective rate of flow through said first flow passage.

3. A solenoid operated valving assembly according to claim 2 wherein said body is comprised of material which does not conduct magnetic flux.

4. A solenoid operated valving assembly according to claim 2 and further comprising an elastomeric member situated between said body and said first armature.

5. A solenoid operated valving assembly according to claim 2 and further comprising a first elastomeric member situated between said body and said first armature, and a second elastomeric member situated between said first armature and said second armature.

6. A solenoid operated valving assembly according to claim 5 wherein said first elastomeric member is operatively carried by said first armature.

7. A solenoid operated valving assembly according to claim 5 wherein said second elastomeric member is operatively carried by said first armature.

8. A solenoid operated valving assembly according to claim 2 wherein said body carries guide means for generally guiding said first armature when said first armature is moving toward said operative engagement with said body.

9. A solenoid operated valving assembly according to claim 2 wherein said body carries guide means for generally guiding said second armature when said second armature is moving toward said operative engagement with said first armature.

10. A solenoid operated valving assembly according to claim 8 wherein said guide means comprises a plurality of guide members spaced from each other and extending generally toward said electrical coil, wherein said first armature comprises a plurality of clearance passages spaced from each other and extending through said first armature, wherein said guide members extend at least through some of said clearance passages, and wherein said guiding of said first armature is accomplished by said first armature moving relative to said guide members.

11. A solenoid operated valving assembly according to claim 2 and further comprising a generally cylindrical magnetic flux conducting member situated generally within said chamber as to be also generally between said electrical coil and said body.

12. A solenoid operated valving assembly according to claim 2 wherein said pole piece comprises a generally cylindrical pole-piece-body portion, wherein said pole-piece-body portion carries an axially extending externally threaded extension, and further comprising a ring-like member, said ring-like member being internally threaded as to be in threadable coaction with said threaded extension, wherein said ring-like member comprises a further body extending generally transversely of said threaded extension, a generally tubular body portion carried by said further body and extending generally axially away from said further body and toward said first armature, wherein said resilient means comprises a compression spring situated about said generally tubular body portion and having one spring end operatively engaged with said first armature.

13. A solenoid operated valving assembly according to claim 12 wherein said resilient means further comprises a second compression spring, wherein said second compression spring is at opposite ends operatively connected to said further body and to said second armature.

14. A solenoid operated valving assembly, comprising a bobbin, said bobbin comprising a generally central cylindrical axially extending tubular portion, a first generally annular outwardly radiating end wall carried by said tubular portion, a second generally annular outwardly radiating end wall carried by said tubular portion, said first and second end walls being axially spaced from each other, an electrical coil carried about said cylindrical axially extending tubular portion and axially contained generally between said first and second end walls, a pole piece situated generally within said axially extending tubular portion, housing means for the general containment therein of said bobbin with said electrical coil and said pole piece, a chamber formed generally between one end of said housing means and said second end wall, a first conduit carried by said housing means and at one end in communication with said chamber, a second conduit carried by said housing means and at one end being effective for communicating with said chamber, a body carried within said chamber and provided with a first flow passage formed therethrough whereby said first flow passage is in communication with said second conduit, a first armature situated in said chamber as to be magnetically acted upon by said pole piece, said first armature being effective to at times open and at other times close said first flow passage, wherein said body is provided with second flow passage means formed therethrough whereby said second flow passage means is effective for providing communication from said chamber to said second conduit, a second armature situated in said chamber as to be magnetically acted upon by said pole piece, said second armature being effective to at times open and at other times close said second flow passage means, said first armature being normally positioned as to close said first flow passage to flow therethrough, said second armature being normally positioned as to close said second flow passage means to any flow therethrough, resilient means effective for resiliently urging said first armature toward operative engagement with said body as to close said first flow passage to flow therethrough, said resilient means being effective for urging said second armature toward operative engagement with said body as to close said second flow passage means to flow therethrough, wherein said second armature is of ring-like configuration with a clearance passage formed therethrough generally centrally thereof, wherein said first armature is situated as to be generally in alignment with said clearance passage, wherein said second flow passage means comprises a plurality of second flow passages spaced from each other and situated as to enable said second armature of ring-like configuration to close all of said plurality of second flow passages to flow therethrough, wherein when said electrical coil is energized to a first extent the magnetic flux through said pole piece is sufficient to cause said first armature to at least start to move away from said body and thereby establish at least a minimal fluid flow as through said first flow passage to thereby establish at least a minimal fluid flow from said first conduit through said chamber and through said first flow passage to said second conduit, and wherein when said electrical coil is energized to a second extent greater than said first extent the magnetic flux through said pole piece is sufficient to cause said second armature to at least start to move away from said body carried within said chamber and thereby establish at least an additional minimal fluid flow as through said plurality of second flow passages to thereby establish at least a further minimal fluid flow from said first conduit through said chamber and through said plurality of second flow passages to said second conduit.

15. A solenoid operated valving assembly according to claim 14 wherein said body is comprised of material which does not conduct magnetic flux.

16. A solenoid operated valving assembly according to claim 14 wherein said body carries guide means for generally guiding said first armature when said first armature is moving toward said operative engagement with said body.

17. A solenoid operated valving assembly according to claim 16 and wherein said clearance passage is of a size and configuration enabling said guide means to pass therethrough.

18. A solenoid operated valving assembly according to claim 14 and further comprising a generally cylindrical magnetic flux conducting member situated generally within said chamber as to be generally between said electrical coil and said body.

19. A solenoid operated valving assembly according to claim 18 wherein said pole piece comprises a generally cylindrical pole-piece-body portion, wherein said pole-piece-body portion carries an axially extending externally threaded extension, wherein said generally cylindrical magnetic flux conducting member has an internally threaded passage formed therethrough, and wherein said externally threaded extension is threadably received by said internally threaded passage.

20. A solenoid operated valving assembly according to claim 14 wherein said resilient means comprises first and second compression springs, wherein said first compression spring is operatively engaged with said first armature, and wherein said second compression spring is operatively engaged with said second armature.

21. A solenoid operated valving assembly, comprising a bobbin, said bobbin comprising a generally central cylindrical axially extending tubular portion, a first generally annular outwardly radiating end wall carried by said tubular portion, a second generally annular outwardly radiating end wall carried by said tubular portion, said first and second end walls being axially spaced from each other, an electrical coil carried about said cylindrical axially extending tubular portion and axially contained generally between said first and second end walls, a pole piece situated generally within said axially extending tubular portion, an armature movable toward and away from said pole piece, a valving member movable by said armature, housing means for the general containment of said bobbin with electrical coil and pole piece and for the general containment of said armature and valving member, a valve seat carried by said housing means, chamber means formed generally by said housing means and at least in part containing said armature and said valving member, a first conduit formed through said housing means and at one end in communication with said chamber means, a second conduit formed through said housing means and having one end generally circumscribed by said valve seat, first resilient means in said chamber means for resiliently urging said valving member toward seating engagement with said valve seat, a fluid flow passage formed through said valving member and at one end communicating with said second conduit when said valving member is in said seating engagement with said valve seat, second resilient means resiliently biasing said armature toward said valving member as to become operatively seated thereagainst, wherein when said armature is operatively seated against said valving member fluid flow from said first conduit and through said fluid flow passage to said second conduit is prevented, wherein when said electrical coil is initially energized to a first extent said valving member remains operatively seated on said valve seat while said armature moves an initial distance away from said valving member thereby enabling fluid flow from said first conduit through said fluid flow passage and into said second conduit, and wherein when said electrical coil is energized to a second extent greater than said first extent said armature moves further toward said pole piece and in so doing causes said valving member to be moved away from said valve seat thereby enabling an increase in the rate of flow of fluid from said first conduit through at least a portion of said chamber means and into said second conduit.

22. A solenoid operated valving assembly according to claim 21 and further comprising lost motion linkage means interconnecting said armature and said valving member whereby a preselected extent of movement by said armature away from said valving member is enabled before said valving member moves in the same direction as said armature.

23. A solenoid operated valving assembly according to claim 22 wherein said lost motion linkage means is connected to said armature and extends into said fluid flow passage of said valving member.

24. A solenoid operated valving assembly according to claim 23 wherein said lost motion linkage means comprises a rod-like member operatively anchored in said armature, wherein said rod-like member freely passes through said fluid flow passage of said valving member, wherein when said armature is operatively seated against said valving member said rod-like member extends a preselected distance beyond said valving member and into said second conduit, and wherein said rod-like member comprises an abutment so that when said armature and rod-like member further move toward said pole piece said abutment operatively engages and causes said valving member to move with said armature.

* * * * *